US011328695B2

(12) United States Patent
Feldman

(10) Patent No.: US 11,328,695 B2
(45) Date of Patent: May 10, 2022

(54) ENDPIN STAND APPARATUS FOR STRINGED INSTRUMENTS

(71) Applicant: Emmanuel Simon Feldman, West Newton, MA (US)

(72) Inventor: Emmanuel Simon Feldman, West Newton, MA (US)

( * ) Notice: Subject to any disclaimer, the term of this patent is extended or adjusted under 35 U.S.C. 154(b) by 0 days.

(21) Appl. No.: 17/110,149

(22) Filed: Dec. 2, 2020

(65) Prior Publication Data

US 2021/0166663 A1 Jun. 3, 2021

Related U.S. Application Data

(63) Continuation-in-part of application No. 16/702,512, filed on Dec. 3, 2019, now Pat. No. 10,885,886.

(60) Provisional application No. 62/775,077, filed on Dec. 4, 2018.

(51) Int. Cl.
*G10D 3/01* (2020.01)

(52) U.S. Cl.
CPC ..... *G10D 3/01* (2020.02)

(58) Field of Classification Search
CPC ..... G10D 3/01; G10D 1/02
See application file for complete search history.

(56) References Cited

U.S. PATENT DOCUMENTS 3,160,050 A * 12/1964 Klein ..... G10D 3/01 84/327

* cited by examiner

*Primary Examiner* — Kimberly R Lockett
(74) *Attorney, Agent, or Firm* — Law Office of Matthew M Yospin; Matthew Yospin

(57) ABSTRACT

Improved endpin stand apparatus for large stringed instruments are provided. The endpin stand apparatus comprises components to elevate the endpin shaft from the floor on which the endpin stand apparatus rests, and may comprise a kickstand. The endpin stand apparatus may comprise an endpin shaft and/or a hole for receiving an endpin shaft, or may comprise a platform, which supports a large stringed instrument. The endpin stand apparatus allows for adjustment of the height of the apparatus and thus of the stringed instrument, and may allow of adjustment of the angle of the instrument relative to the axis defined by the apparatus. The apparatus allows a user to stand while playing the instrument, and to move through a forward-to-back and side-to-side range of motion. The adjustable height and angle allow for a range of instrument locations and angles, and increased range of motion by the musician while playing the instrument.

19 Claims, 14 Drawing Sheets

ENDPIN STAND APPARATUS FOR STRINGED INSTRUMENTS

FIELD OF THE INVENTION

The presently disclosed subject matter relates to endpin stand apparatus for stringed instruments, and more particularly, to endpin stand apparatus with platform, with kickstand, or with both, that allow adjustment of the instrument height and angle of support through a range of heights and angles relative to the instrument.

BACKGROUND OF THE INVENTION

Large stringed instruments, including but not limited to the cello and the upright bass, are heavy instruments that must be supported on the floor, in nearly all uses of the instruments, so that a musician can play them. Traditionally, instruments are supported with a straight endpin that protrudes from the bottom of the instrument, known as the lower rib area. The endpin is braced to the instrument with a small endpin support that is external to the instrument and which in most instances has an element that spans into the internal space of the instrument, in contact with a part of the instrument that is a reinforcing block inside the lower rib area of the instrument, which reinforcing block is in contact with the inside surface of the instrument body panels comprising the lower rib area. Traditional endpins protrude straight out of the instrument, parallel to the long axis of the instrument and perpendicular to the exterior surface of the instrument at the lower rib area. They can be adjusted for length but not adjusted to be affixed to the instrument at any other angle, or to be affixed in any location other than a single hole placed in the lower rib area of the instrument, which hole is typically in the center of the lower rib area. Traditional endpins also have a limited range of heights available to them, with limitations imposed by the tensile strength of materials available to be used, the length of adjustable endpins, and the diameter of the hole in the instrument's lower rib area and the support of the endpin sufficient to support the torque imposed on the lower rib area by the weight of the instrument when supported by a longer-than-traditional endpin. For a traditional endpin, which telescopes in two sections, the length in use is typically in the range of approximately 14" to 15". For shorter musicians, the endpin as used may be set at a height of approximately 6" to 8". For taller musicians, the endpin as used may be set at a height of approximately 16" to 17". Traditional telescoping endpins are understood to be impossible, impractical, or unsafe to use at lengths of approximately 20" or longer than 20", as the endpin at that extension may not adequately support the weight of the instrument. Because large stringed instruments are both expensive and fragile, accessories and modifications that are not reliably safe are undesirable. These limitation of prior art endpins make it unsafe or impossible for nearly all musicians to play while standing.

Typical prior art endpins have only two sections, to allow insertion of the endpin into the instrument without needing to remove the endpin from the instrument when the endpin is not in use, and to allow the instrument to fit into a case. Additionally, a traditional endpin, if made longer, may need to telescope with more than two sections, so that the lengths of endpin sections may be inserted into the instrument when not in use, both for safety to reduce trip hazards and the risk of damage to the instrument, and to make it feasible to fit the instrument into an instrument case to allow for safe storage and transportation of the instrument. An endpin that included a third section, or more than three, to extend farther than a traditional endpin, would increase the risk of damage to the endpin and thus the instrument, by introducing one or more sections of endpin that are necessarily smaller in diameter and therefore weaker and more prone to mechanical failure.

For these reasons, large stringed instruments, such as cellos are typically played only while seated, because the instrument cannot be supported at a sufficient height to allow most musicians to play while standing. This limitation in playing positions leads to other problems, including ergonomic problems and repetitive stress injuries (RSI) suffered by musicians, and constraints on the freedom of motion of the musician while playing seated, specifically in the ability of the musician to sway forward and back while playing, or to sway side-to-side. For definition of a reference frame, if one faces an upright instrument with the strings approximately vertical and facing the viewer, the x axis is side-to-side along the instrument, the y-axis is front to back on the instrument, and the z-axis is vertical along the instrument. The forward-and-back motion referred to in the present disclosure refers to motion in the y-z plane, which may be a rotation about the x-axis, and the side-to-side motion referred to in the present disclosure refers to motion parallel to the x-z plane, which may be a rotation about the y-axis.

Finally, the constraint of playing only while seated makes some concert venues or performance formats challenging for musicians using large stringed instruments.

Accordingly, the problems with the prior art for endpins or any apparatus replacing or supplementing an endpin for stringed instruments include a limited range of height available to the musician, in particular a limit on heights larger than 15" or 20"; providing a sufficiently high endpin or endpin support that is both strong enough for safe use, and may be easily and safely packed and transported; ergonomic problems and repetitive stress injuries (RSI) suffered by musicians; constraints on the freedom of motion of the musician while playing seated; and limitations on performance formats imposed by playing seated.

SUMMARY OF THE INVENTION

The present invention meets all these needs, by disclosing endpin stand apparatus for stringed instruments that may be used with a string instrument with little or no irreversible modifications, or any modifications at all, to the instrument, with much reduced or no risk of damaging the instrument. In one aspect of the present invention, the present invention allows an instrument to be used at a greater height and greater range of heights than is possible with the prior art, allowing musicians to stand while playing, presenting a solution to a range of ergonomic and RSI problems for musicians, and allowing greater musical expressiveness with an improved range of movement available to the musician using the present invention. The present invention facilitates improved and higher support of a stringed instrument and improved adjustability by each musician playing an instrument, including support at approximately 20" of height and higher, such as approximately 24" to 25" high for many musicians, and opens up a range of playing positions and performance venues for musicians playing large stringed instruments.

In one aspect of the present disclosure, the disclosed apparatus allows people to quickly and easily use the invention with their existing instruments, and enables improved support of each instrument, by allowing for an adjustable range of heights for the instrument relative to the floor. By enabling higher support for the instrument, the musician may stand, and the risk of ergonomic or RSI for the musician is greatly reduced, as the musician is not required to sit and lean forward while holding up the instrument and moving to play the instrument, and can move to play the instrument without needing to lean forward and/or to a side, as is typically done by a musician playing a large string instrument while seated.

Furthermore, in another aspect of the present disclosure, the disclosed apparatus allows for use of a plurality of endpins comprising a range of angles, offsets, and orientations by the musician. The musician may choose different short endpin shafts for use with the endpin stand apparatus, and swap them in and out of use as components of the apparatus. This represents a great improvement over the current art, in which endpin adjustment is difficult or impossible.

In another aspect, the present disclosure allows the use of a plurality of interchangeable endpin shafts, which may be straight, angled, or hinged.

In another aspect of the present disclosure, the apparatus allows for a platform to be used to support the instrument.

In another aspect of the present disclosure, the apparatus allows for a kickstand to be used to further stabilize the endpin stand apparatus.

In one aspect, the present disclosure comprises: a ground tube; an upright tube; an upright-ground connector; an internal tube; an upright-internal fastener; and a platform.

In one aspect, the present disclosure comprises wherein the platform further comprises: a platform base, the platform base further comprising: a platform hole and a platform cup, and wherein the platform cup is disposed under the platform hole; a plurality of cup-platform-fasteners, wherein the plurality of cup-platform-fasteners reversibly affix the platform cup to the platform base; a plurality of cup-bracket-fasteners; and a bracket, wherein the bracket reversibly affixes the platform cup to the internal tube, and wherein the plurality of cup-bracket-fasteners reversibly affix the platform cup to the bracket.

In one aspect, the present disclosure comprises wherein the platform further comprises a bracket-tube fastener.

In one aspect, the present disclosure comprises wherein the bracket is snugly fitted to the internal tube or the upright tube.

In one aspect, the present disclosure comprises wherein the platform cup is sized and shaped such that an endpin plug or an endpin block of the stringed instrument can be passed through the platform hole when the stringed instrument is placed on the platform, to accommodate the endpin plug or the endpin block and allow movement of the endpin plug or the endpin block within the platform cup.

In one aspect, the present disclosure comprises wherein the platform base is flat.

In one aspect, the present disclosure comprises wherein the platform base is curved.

In one aspect, the present disclosure comprises wherein the platform base can be rotated side-to-side and front-to-back.

In one aspect, the present disclosure comprises wherein the platform base is covered in part or in whole with a platform padding.

In one aspect, the present disclosure comprises wherein the platform padding is reversibly attached to and removed from the platform base with a plurality of padding fasteners.

In one aspect, the present disclosure comprises wherein the platform further comprises a platform-rear-support.

In one aspect, the present disclosure comprises wherein the platform further comprises a platform-rear-support-padding and a plurality of padding fasteners, and wherein the platform-rear-support is covered in part or in whole with the platform-rear-support-padding, and wherein the platform-rear-support-padding is reversibly attached to and removed from the platform-rear-support with the plurality of padding fasteners.

In one aspect, the present disclosure comprises wherein the platform further comprises a platform-front-support, a platform-front-support-padding and a plurality of padding fasteners, and wherein the platform-front-support is covered in part or in whole with the platform-front-support-padding, and wherein the platform-front-support-padding is reversibly attached to and removed from the platform-front-support with the plurality of padding fasteners.

In one aspect, the present disclosure comprises wherein the platform further comprises a plurality of platform-tilt-mechanisms.

In one aspect, the present disclosure comprises wherein the plurality of platform-tilt-mechanisms comprise a plurality of platform-tilt-panels; a plurality of platform-tilt-adjusters; and a plurality of platform-tilt-hinges.

In one aspect, the present disclosure comprises: a ground tube; an upright tube, the upright tube comprising an upright-kickstand-tube joint; an upright-ground connector; an internal tube; an upright-internal fastener; and a kickstand, wherein the kickstand comprises a kickstand-tube and a kickstand-upright-fastener, which kickstand-upright-fastener reversibly attaches the kickstand-tube to the upright tube at the upright-kickstand-tube joint.

In one aspect, the present disclosure comprises wherein the kickstand reversibly folds against the endpin stand apparatus.

In one aspect, the present disclosure comprises wherein the kickstand further comprises a kickstand-base, the kickstand-base being approximately perpendicular to the kickstand-tube, and wherein the kickstand-base is reversibly affixed to and removed from the kickstand-tube.

In one aspect, the present disclosure comprises wherein the kickstand further comprises a plurality of kickstand-feet, wherein the plurality of kickstand-feet are reversibly affixed to the kickstand-base.

In one aspect, the present disclosure comprises: an upright tube, the upright tube comprising an upright-kickstand-tube joint; an internal tube; an upright-internal fastener; a platform, wherein the platform further comprises a plurality of platform-tilt-mechanisms; and a kickstand, wherein the kickstand comprises a kickstand-tube and a kickstand-upright-fastener, which kickstand-upright-fastener reversibly attaches the kickstand-tube to the upright tube at the upright-kickstand-tube joint.

These aspects of the present disclosure, and others disclosed in the Detailed Description of the Drawings, represent improvements on the current art. This summary is provided to introduce a selection of concepts in a simplified form that are further described below in the Detailed Description of the Drawings. This Summary is not intended to identify key features for essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, there is shown in the drawings exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which.

DETAILED DESCRIPTION OF THE DRAWINGS

Figure 1:
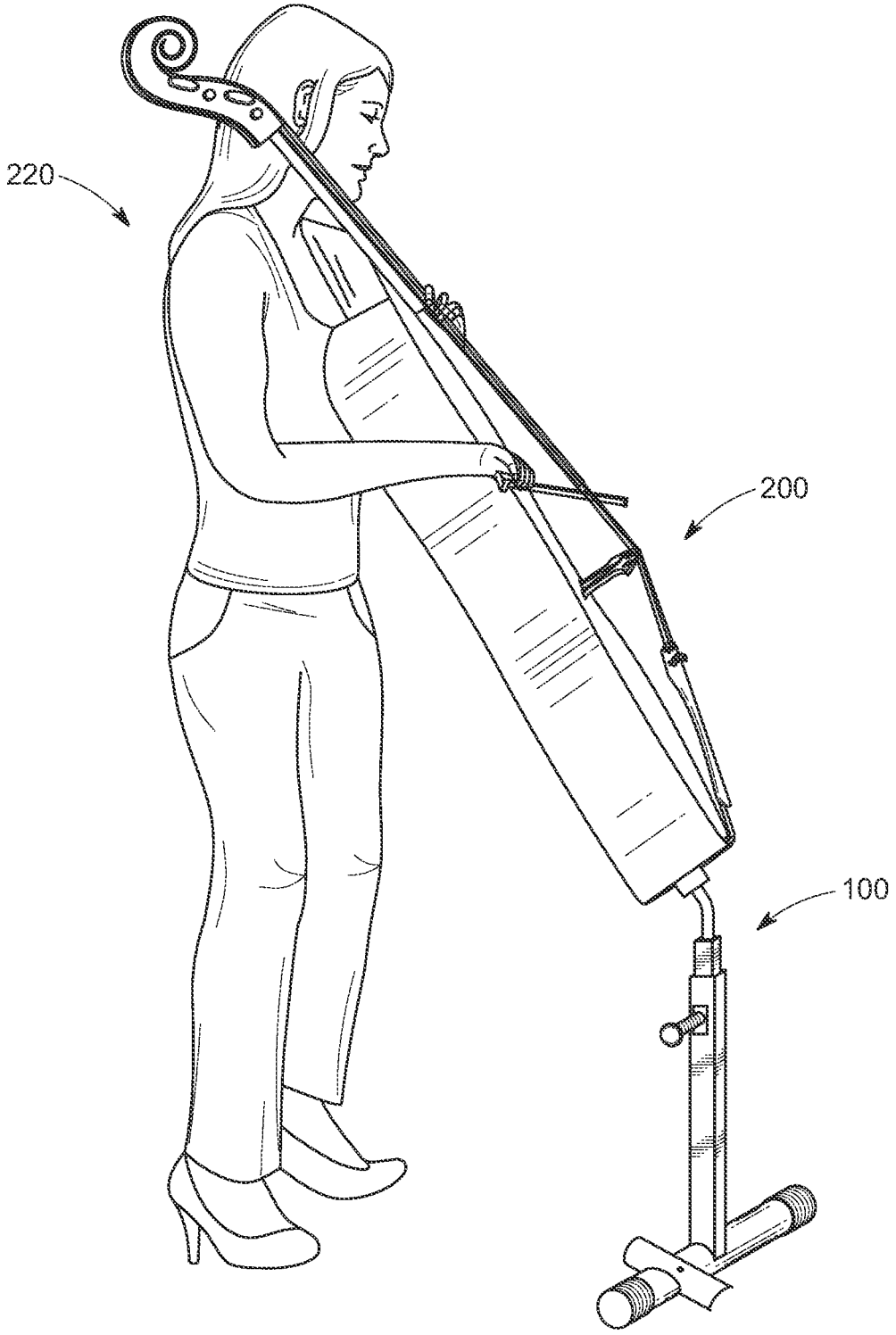
FIG. 1 shows a perspective view of a musician playing a stringed instrument (here, a cello) with an aspect of the present invention.

The presently disclosed invention is described with specificity to meet statutory requirements. But, the description itself is not intended to limit the scope of this patent. Rather, the claimed invention might also be presented in other aspects, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described. The word "approximately" as used herein means within 5% of a stated value, and for ranges as given, applies to both the start and end of the range of values given.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the methods and systems of the present invention.

The present subject matter discloses aspects of improved endpin stand apparatus for use on and support of stringed instruments. At a high level of overview, the endpin stand apparatus 100 of the present invention is made, in various aspects, so that the endpin stand apparatus 100 may be used with a stringed instrument 200 with little or no modification of the instrument's body, and the endpin stand apparatus 100 allows a musician 220 using the stringed instrument 200 with the endpin stand apparatus 100 to stand, or sit in a higher seat than is possible with prior-art endpins, and allows the musician 220 a choice of the height of the endpin stand apparatus 100 and a choice of the endpin shaft 160 or platform 300 used with the stringed instrument 200, providing better support of the stringed instrument 200 and an improved range of positions which the musician 220 may employ while playing the stringed instrument 200.

Figure 2:
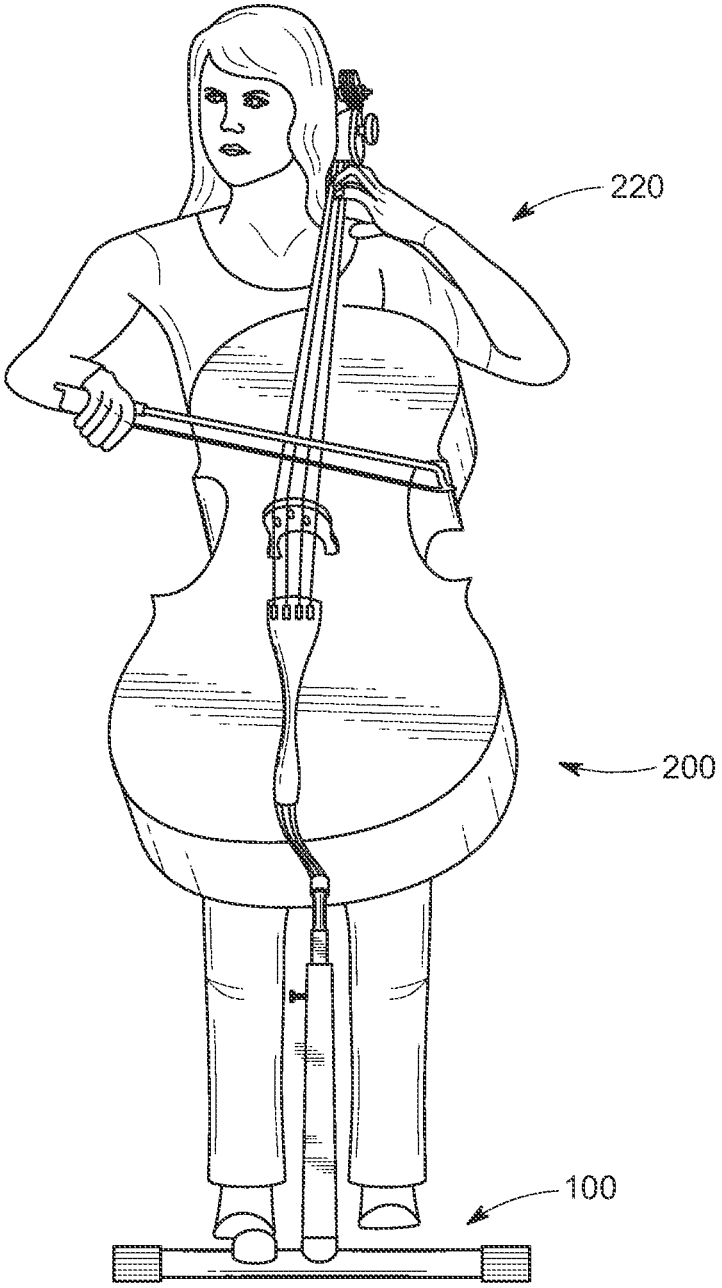
FIG. 2 shows a front elevation view of a musician playing a stringed instrument (here, a cello) with an aspect of the present invention.

With reference to FIG. 1 and FIG. 2, a musician 220 is shown playing a stringed instrument 200 that is supported by an endpin stand apparatus 100 of the present invention.

Figure 3:
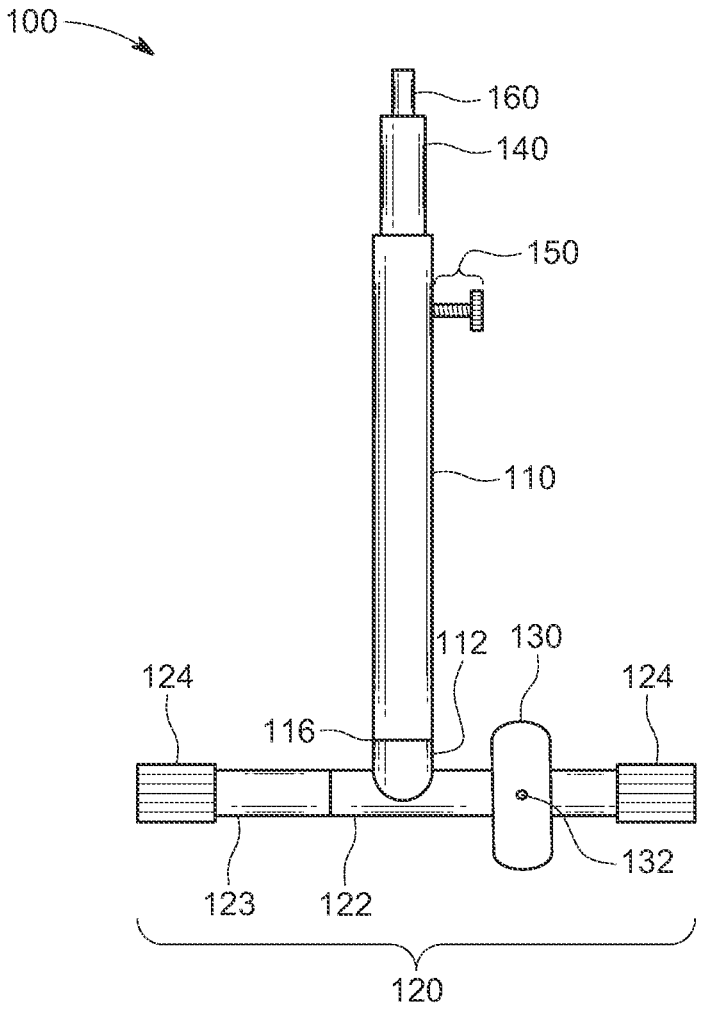
FIG. 3 shows a front elevation view of an exemplary endpin stand apparatus of the present invention.
Figure 11:
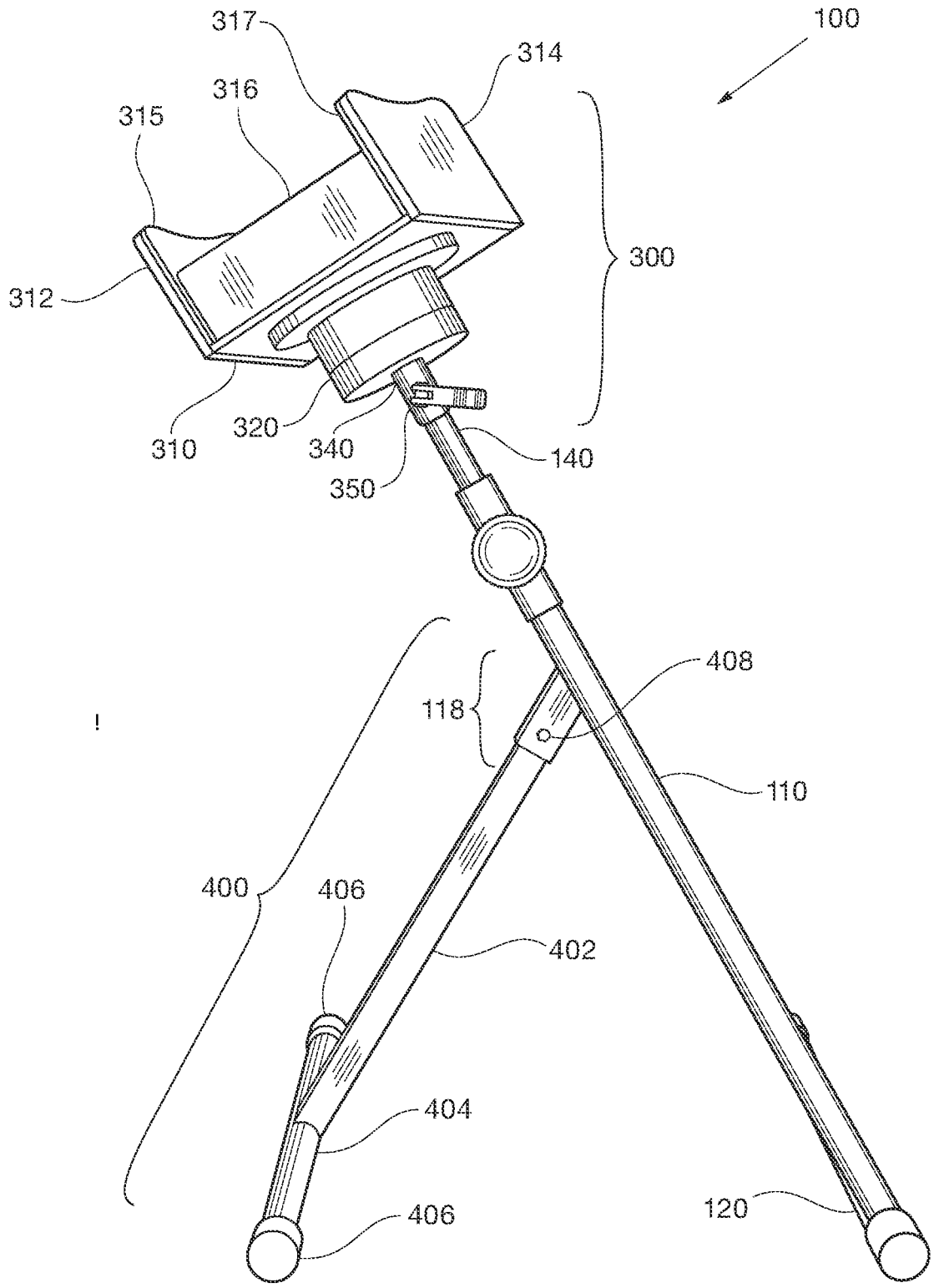
FIG. 11 shows a side perspective view of an exemplary endpin stand apparatus of the present invention.
Figure 12:
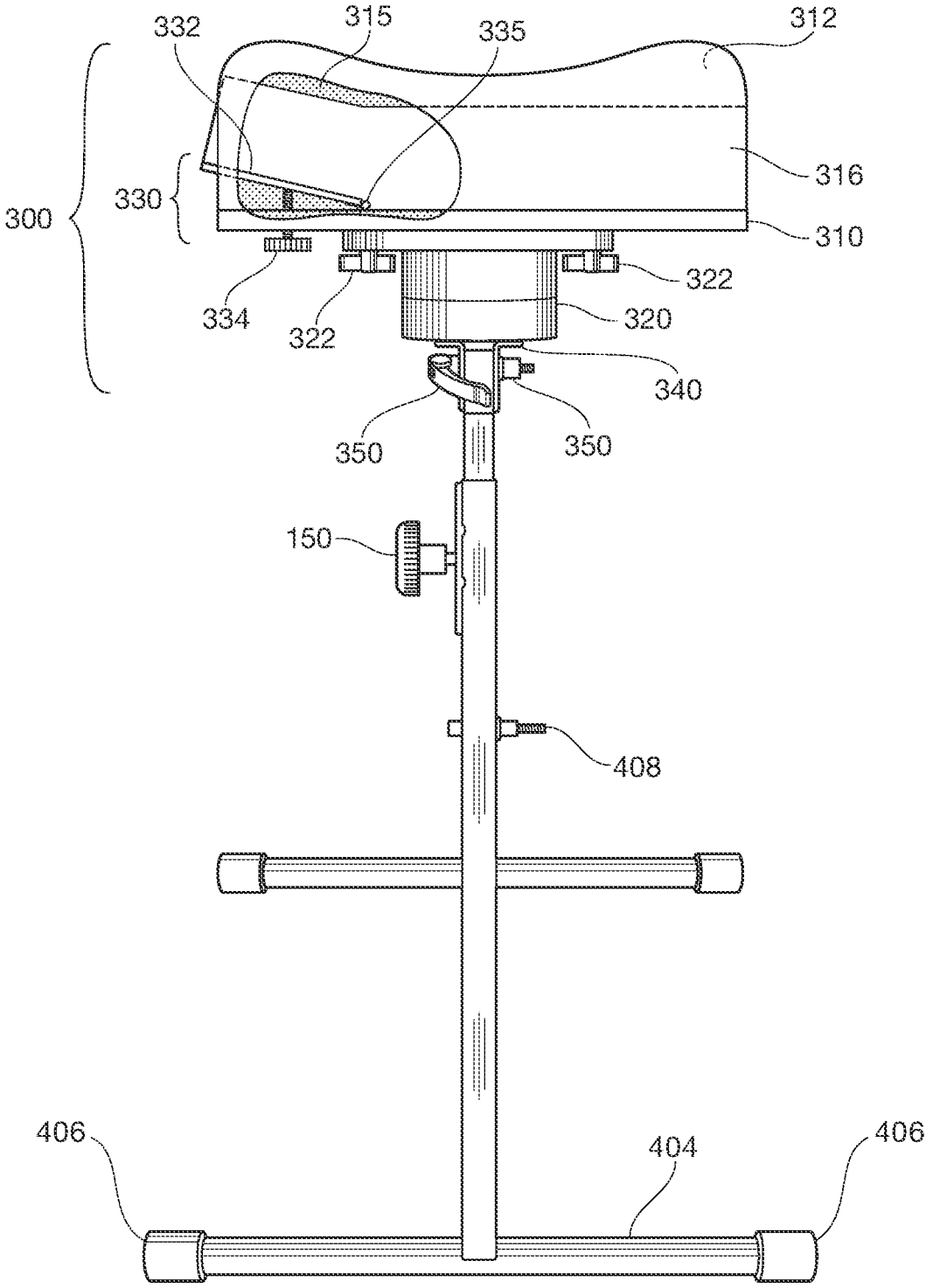
FIG. 12 shows a front elevation view, with partial cutaway, of an exemplary endpin stand apparatus of the present invention.
Figure 13:
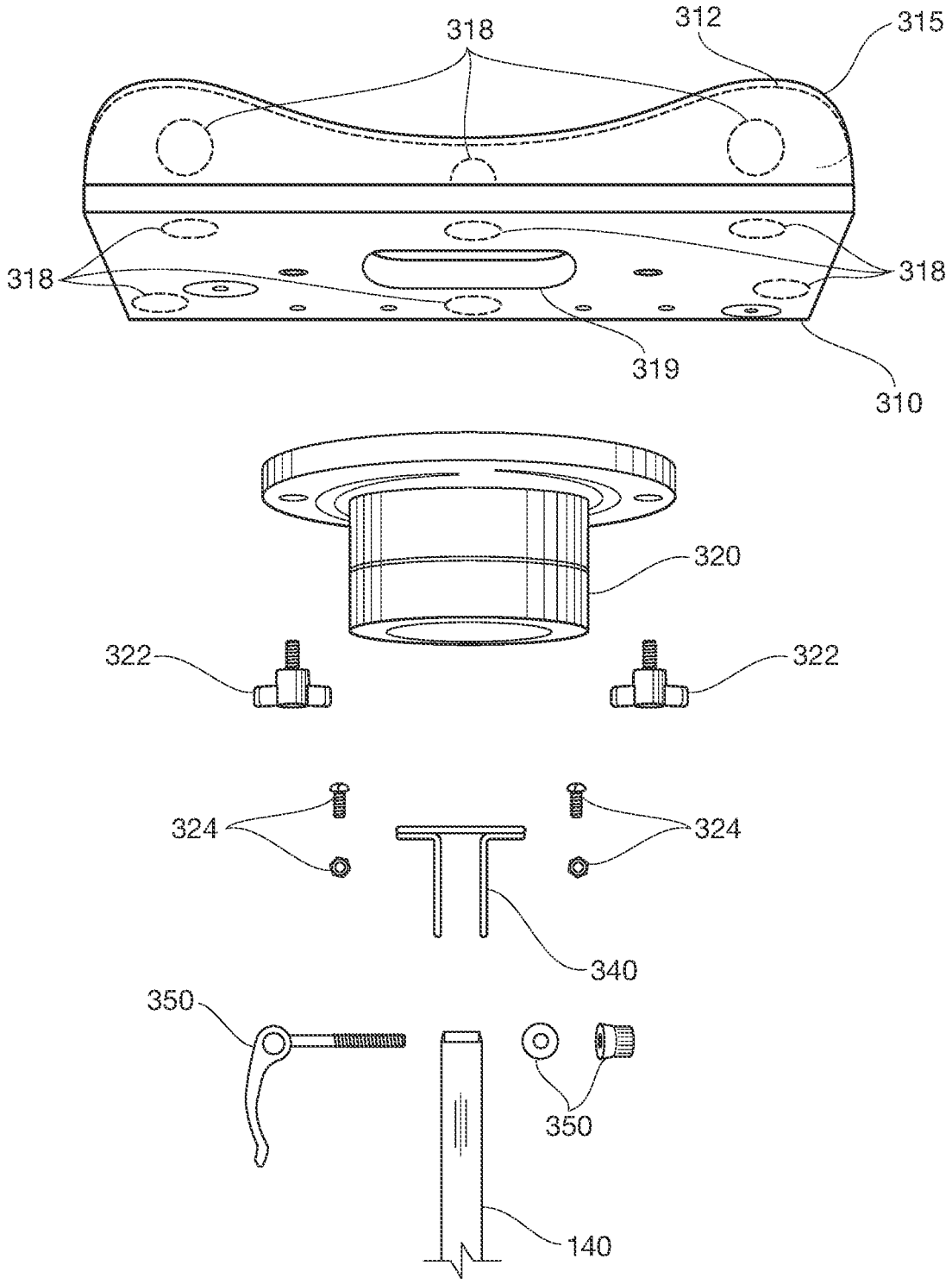
FIG. 13 shows an exploded front perspective view of a portion of an exemplary endpin stand apparatus of the present invention.

With reference to FIG. 3, FIG. 11, and FIG. 12, an aspect of the invention is depicted. The endpin stand apparatus 100 comprises a ground tube 120, an upright tube 110, an upright-ground connector 112, an internal tube 140, and an upright-internal fastener 150. The endpin stand apparatus 100 may further comprise an endpin shaft 160. The endpin stand apparatus 100 may further comprise a platform 300. The endpin stand apparatus 100 may further comprise a kickstand 400.

With reference to FIG. 3, FIG. 4, FIG. 5, and FIG. 6, the ground tube 120 is disposed to sit on or at the floor or ground where the musician 220 has the stringed instrument 200. As used herein, the term "floor" is to be understood as encompassing any object or surface on which a stringed instrument 200 may be placed, including but not limited to the interior of a building, the ground or a rock, a vehicle, a platform, or any structure or object. The endpin stand apparatus 100 of the present invention should sit on the floor or ground, and should meet the stringed instrument 200 at such an angle that the upright tube 110 (and the internal tube 140 inside the upright tube 110) are approximately vertical and approximately perpendicular to the floor or ground. It has been found advantageous to have the upright tube 110 be approximately perpendicular to the floor or ground, so that the ground tube 120 and the ground feet 124 (or the plurality of ground blocks 128 or the ground plate 126, as disclosed below in other aspects of the present invention) meet the floor with most of the weight of the stringed instrument 200 directed down so as to maximize the frictive forces between the floor and the endpin stand apparatus 100 and therefore reduce the risk of the endpin stand apparatus 100 sliding along the floor, as opposed to having a significant component of the force directed sideways, which would reduce the frictive forces between the floor and the endpin stand apparatus 100 and increase the risk of the endpin stand apparatus 100 sliding and the stringed instrument 200 being damaged. As is discussed below in greater detail, an endpin shaft 160 component of the present invention may be a straight endpin shaft 161 or an angled endpin shaft 162 or a hinged endpin shaft 163, and a plurality of endpin shaft 160 may be used and may be interchangeable, such that the angle between the internal tube 140 and the stringed instrument 200 is such that the upright tube 110 is approximately vertical and approximately perpendicular to the floor or ground, and the stringed instrument 200 is not vertical so that it is at a comfortable position to be played. To that end, an angled endpin shaft 162 may be desirable when in use with a stringed instrument 200 using a traditional round endpin support that allows only for a straight path of a traditional endpin in and out of the lower rib area of the stringed instrument 200 (that is, along the long axis of the stringed instrument 200). In contrast, a straight endpin shaft 161 may be desirable when in use with a stringed instrument 200 using an endpin support that allows for an endpin to be supported at an angle relative to the long axis of the stringed instrument 200.

Figure 4:
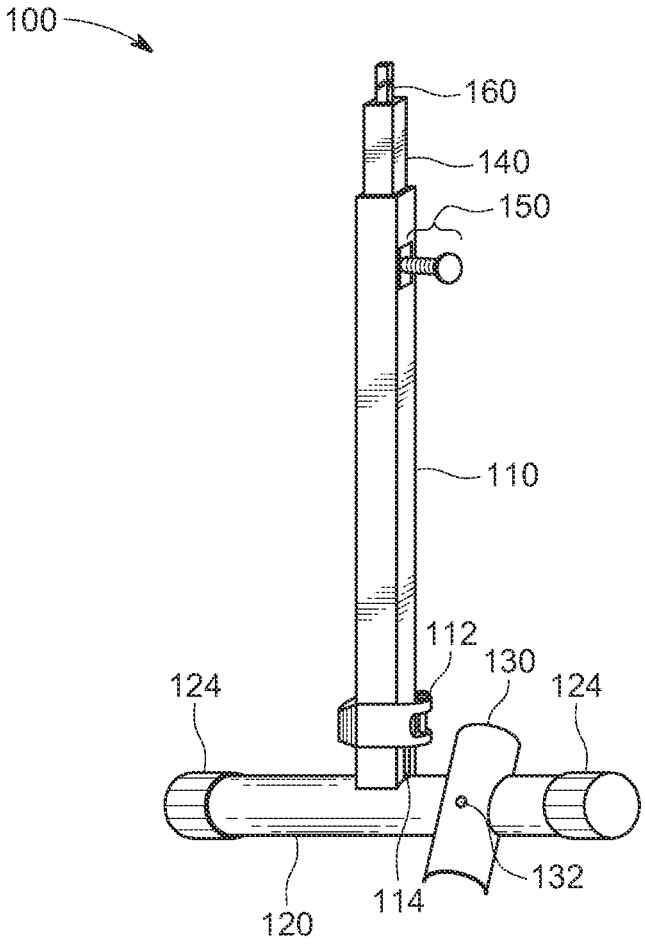
FIG. 4 shows a perspective view of an exemplary endpin stand apparatus of the present invention.
Figure 5:
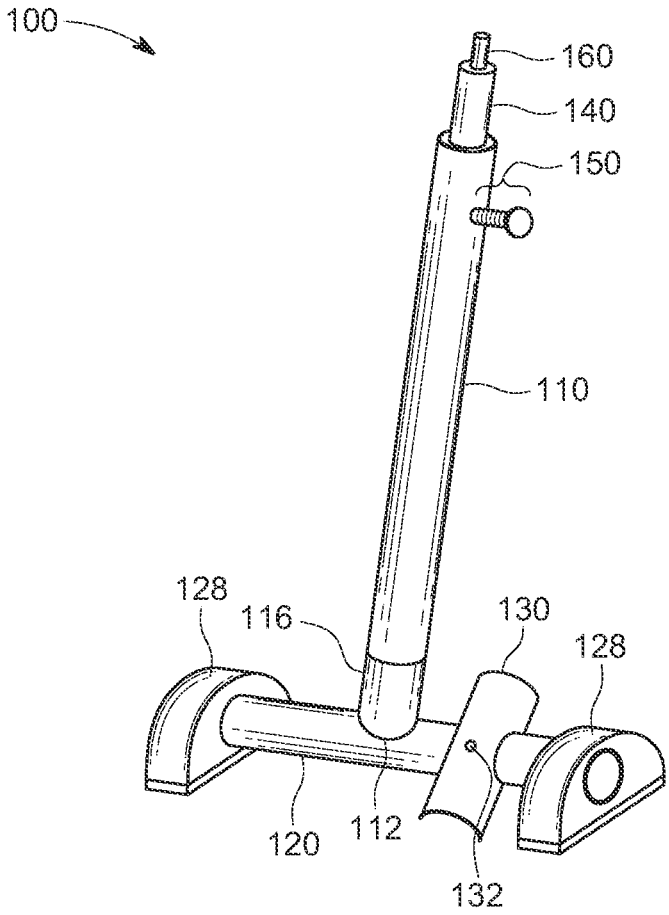
FIG. 5 shows a perspective view of an exemplary endpin stand apparatus of the present invention.
Figure 6:
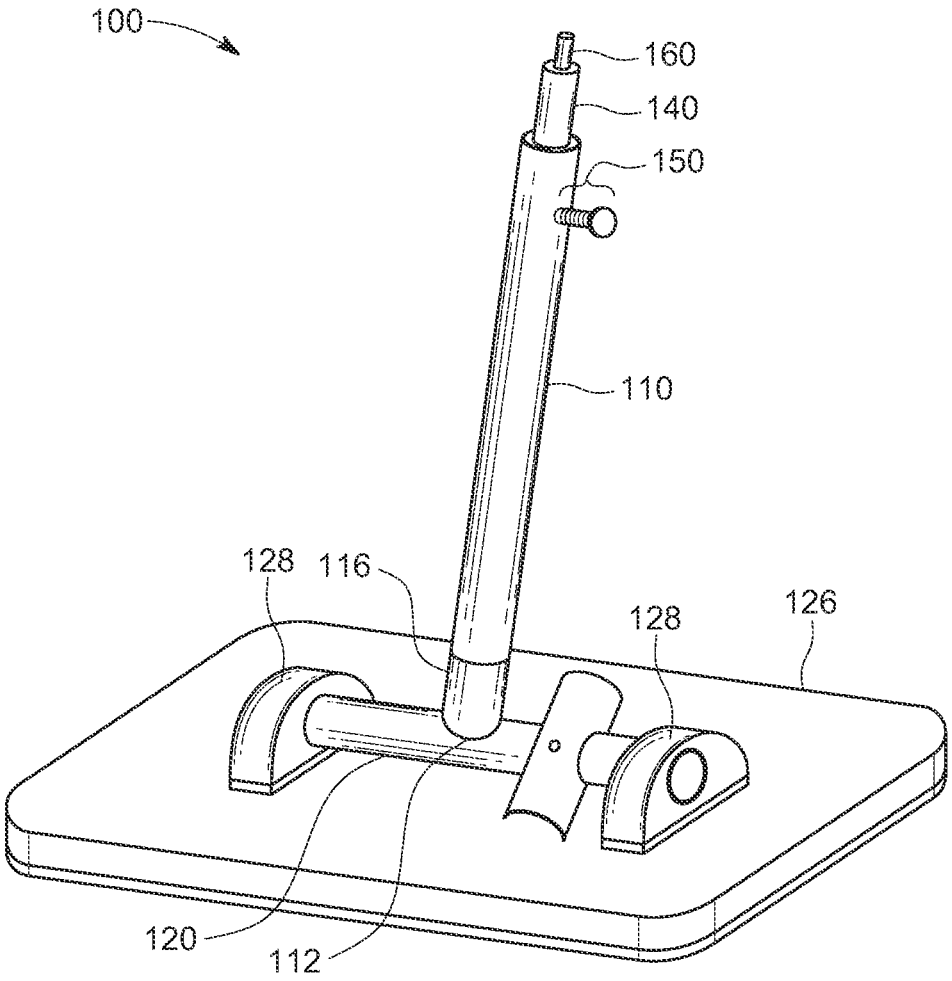
FIG. 6 shows a perspective view of an exemplary endpin stand apparatus of the present invention.
Figure 7:
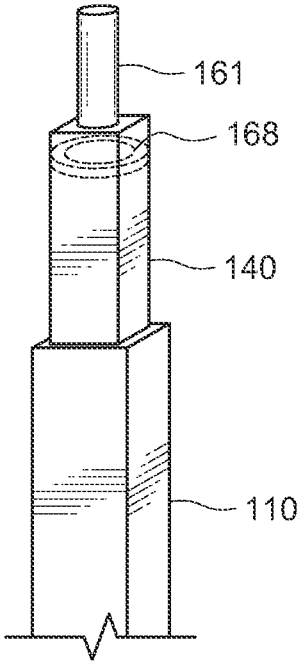
FIG. 7 shows a perspective view of a portion of an exemplary endpin stand apparatus of the present invention.
Figure 8:
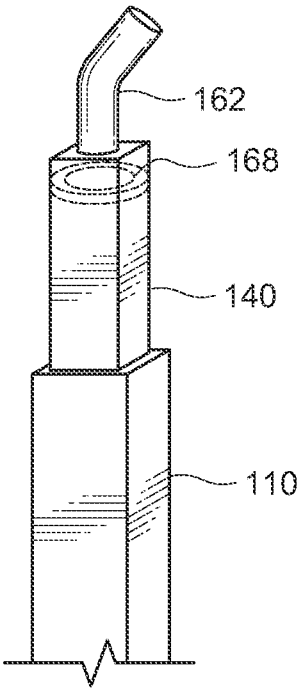
FIG. 8 shows a perspective view of a portion of an exemplary endpin stand apparatus of the present invention.
Figure 9:
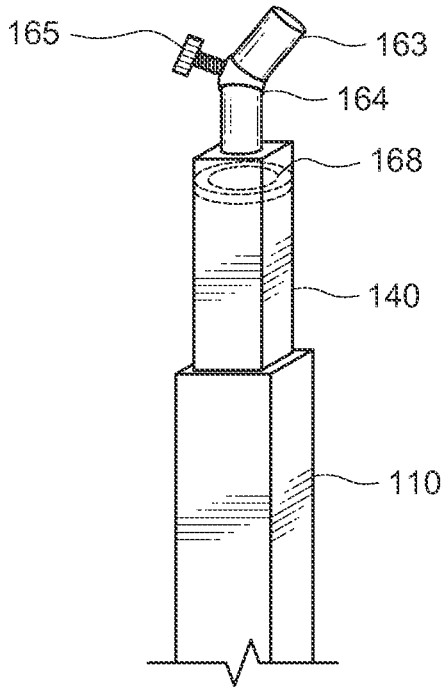
FIG. 9 shows a perspective view of a portion of an exemplary endpin stand apparatus of the present invention.

The ground tube 120 may comprise a single piece of material, as is shown in FIG. 4, FIG. 5, and FIG. 6, or may comprise more than one piece of material, as is shown in FIG. 3, in which the ground tube 120 comprises a ground tube first piece 122 and a ground tube second piece 123, which may be joined together with screw threads, a pressure fitting, one or more spring-locking latches, a set screw, or other means now known or later invented. Where the ground tube 120 comprises more than one piece of material, the ability to disassemble and reassemble the ground tube 120 makes storage and transport of the endpin stand apparatus 100 simpler. The ground tube 120 may advantageously be circular in cross-section, though other cross-sectional shapes of the ground tube 120 are possible. The ground tube 120 may be straight, or may be curved, or have another shape including but not limited to a split or branched shape. The ground tube 120 may have a rocker-stabilizer 130 attached to the ground tube 120 with a ground-rocker connector 132. The rocker-stabilizer 130 may be an approximately flat rectangle of material, or may be any other shape, or may advantageously be shaped like a half of a cylinder, with a section cut out from each side to match the shape of the ground tube 120, such that the rocker-stabilizer 130 is shaped to closely align with the ground tube 120. The rocker-stabilizer 130 may be used by the musician 220 as a footrest when playing the stringed instrument 200 mounted on the endpin stand apparatus 100, and/or to adjust the angle of the stringed instrument 200 by movement of the foot of the musician 220, whether the musician 220 is currently playing or not. The rocker-stabilizer 130 may also be used to stabilize the endpin stand apparatus 100 when the musician 220 is mounting the stringed instrument 200 on the endpin stand apparatus 100, or when the musician 220 is removing the stringed instrument 200 from the endpin stand apparatus 100. In some aspects, there may be a plurality of rocker-stabilizers 130, providing an advantage to a musician 220 who wishes to switch which foot the musician 220 is using on the rocker-stabilizer 130.

The ground tube 120 may comprise at least two ends, at its extremities distal from the upright tube 110, and may have a plurality of ground feet 124 mounted on the ground tube 120, disposed at or near the ends of the ground tube 120. The plurality of ground feet 124 serve to provide a frictive connection between the endpin stand apparatus 100 and the floor, such that the endpin stand apparatus 100 does not slip or slide while the musician 220 is playing the stringed instrument 200. Any such movement of the endpin stand apparatus 100 along the floor could lead to damage to the stringed instrument 200, injury to the musician 220, and errors in the performance by the musician 220, or a distraction during the performance.

The ground tube 120 may be connected to and disconnected from the upright tube 110 with the upright-ground connector 112. The upright-ground connector 112 may comprise screw threads, a pressure fitting, a clamp such as that depicted in FIG. 5, one or more spring-locking latches, a set screw, or other means now known or later invented. The upright-ground connector 112 serves to allow the ground tube 120 to be attached to and detached from the upright tube 110. When detached, the storage and transport of the endpin stand apparatus 100 is simpler as the endpin stand apparatus 100 may be packed into a relative small package or container, and carried with the stringed instrument 200 in the case of the stringed instrument 200, or alongside such a case. The upright-ground connector 112 may be fixedly attached to the upright tube 110, or may be fixedly attached to the ground tube 120, or the upright-ground connector 112 may be removably attached to each of the upright tube 110 and the ground tube 120. The upright tube 110 attaches to either the upright-ground connector 112 or directly to the ground tube 120 at an upright-tube joint 116.

With reference to FIG. 3, FIG. 4, FIG. 5, FIG. 6, FIG. 7, FIG. 8, FIG. 9, and FIG. 10, the upright tube 110 and the internal tube 140 are, advantageously, concentric with the upright tube 110 larger than the internal tube 140, such that the internal tube 140 may be disposed snugly within the upright tube 110, and the internal tube 140 may slide within the upright tube 110 so that the musician 220 may adjust a height of the endpin stand apparatus 100 by sliding the internal tube 140. The endpin stand apparatus 100 may be used at a height of approximately 20" or higher, such as a height of approximately 24"-25" high for a musician 220 of approximately average height, or may be used at a height of approximately 28"-30", or higher, for a musician 220 who is taller than an average height. The internal tube 140 may be fixed in place relative to the upright tube 110 by use of the upright-internal fastener 150, at the height of the endpin stand apparatus 100 selected by the musician 220 for playing the stringed instrument 200, or may be collapsed as short as possible for storage and transport. The upright-internal fastener 150 may be a set screw, as is shown in FIG. 3, FIG. 4, FIG. 5, and FIG. 6, or may be a quick-release clamp or other suitable fastener mechanism now known or later invented that will serve to reversibly fasten and be released, to secure the upright tube 110 and the internal tube 140 together, as will be understood by one of skill in the art. The upright tube 110 and the internal tube 140 may advantageously be circular in cross-section, as shown in FIG. 3, FIG. 5, and FIG. 6, or may advantageously be square in cross-section, as shown in FIG. 1, FIG. 4, FIG. 7, FIG. 8, and FIG. 9, though other cross-sectional shapes of the upright tube 110 and the internal tube 140 are possible.

With reference to FIG. 4, an aspect of the present invention is that the connection between the ground tube 120 and the upright tube 110 may be by means of an upright-ground slot 114, in which a protrusion from the ground tube 120 aligns with the upright-ground slot 114 in the lower end of the upright tube 110, such that the upright-ground slot 114 may slide over the ground tube 120. The upright tube 110 may then be fastened to the ground tube 120 by clamping the upright-ground connector 112 around at least part of the upright tube 110 at the upright-ground slot 114, so as to secure the upright tube 110 to the ground tube 120.

Also with reference to FIG. 4, the cross-sectional shape of the ground tube 120 does not have to be the same as the cross-sectional shapes of the upright tube 110 and the internal tube 140.

With reference to FIG. 5, in an aspect of the present invention, the ground tube 120 may be attached to a plurality of ground blocks 128 with freedom of movement to rotate axially while remaining attached to the plurality of ground blocks 128, which plurality of ground blocks 128 are advantageously larger than the plurality of ground feet 124 present in other aspects of the present invention. The ground tube 120 may be rotated by the musician 220 within and relative to the plurality of ground blocks 128, such as by use of the rocker-stabilizer 130 as previously described, to allow adjustment of the angle and position of the endpin stand apparatus 100 and to stabilize the endpin stand apparatus 100 as described herein, while the plurality of ground blocks 128 may provide more stability and frictional connection to the floor, in this aspect of the present invention, than the plurality of ground feet 124 may.

With reference to FIG. 6, in an aspect of the present invention, the endpin stand apparatus 100 may further comprise a ground plate 126, to which the plurality of ground blocks 128 may be affixed. In such aspects of the present invention, the ground plate 126 would sit on the floor or ground, and the plurality of ground blocks 128 may allow the ground tube 120 to rotate within the ground blocks 128, to provide the aforementioned adjustability and stability of the endpin stand apparatus 100, as previously disclosed herein.

With reference to FIG. 7, FIG. 8, FIG. 9, and FIG. 10, and with reference to FIG. 3, FIG. 4, FIG. 5, and FIG. 6, the endpin stand apparatus 100 may comprise, at the upper end (the end away from the upright tube 110 and the ground tube 120) of the internal tube 140, an endpin shaft 160, which, as discussed previously, may be a straight endpin shaft 161 or may be an angled endpin shaft 162 or may be a hinged endpin shaft 163, and any of the foregoing aspects of an endpin shaft 160 may be, it has been found advantageous, interchangeable in use with the endpin stand apparatus 100. Any endpin shaft 160 may, it has been found advantageous, be a cylinder of material suitably strong to support the weight of the stringed instrument 200; specifically this includes but is not limited to a straight endpin shaft 161 or an angled endpin shaft 162 or a hinged endpin shaft 163. In contrast to traditional adjustable endpins, the endpin shaft 160 may be approximately 2" to approximately 8" long, and, it has been found advantageous, is not adjustable, though an endpin shaft 160 as described herein may be adjustable as may be desirable in some aspects, including but not limited to the hinged endpin shaft 163 that is hinged and can be fixed at a hinge-angle as desired by the musician 220, which allows for a range of adjustment of the hinged endpin shaft 163 to allow the musician 220 to adjust the angle at which the musician 220 holds the stringed instrument 200, and the angle at which the endpin stand apparatus 100 meets the floor. The hinged endpin shaft 163 comprises a top end and a bottom end disposed opposite each other, and an endpin shaft catchment 164, which allows the two ends of the hinged endpin shaft 163 to be adjusted relative to each other and remain fixed as a hinged endpin shaft 163, and an endpin shaft fastener 165 to fasten the endpin shaft catchment 164 and fix the hinged endpin shaft 163 at a particular angle chosen by the musician 220. The upper end of the internal tube 140 may comprise an internal-endpin shaft hole 166. In some aspects of the present invention, the upper end of the internal tube 140 may comprise both an endpin shaft 160 and an internal-endpin shaft hole 166. The upper end of the internal tube 140 may further comprise an internal-endpin connector 168, which internal-endpin connector 168 may be threaded, or hinged, or a ball-bearing or pressure fit mount, or other connection now known or later invented, which serves to connect the endpin shaft 160 to the internal tube 140. In an aspect of the present invention, the internal-endpin connector 168 may allow the endpin shaft 160 to be affixed to and removed from the internal tube 140. In an aspect of the present invention, the internal-endpin shaft hole 166 may allow the endpin shaft 160 to be inserted into and removed from the internal tube 140.

Figure 10:
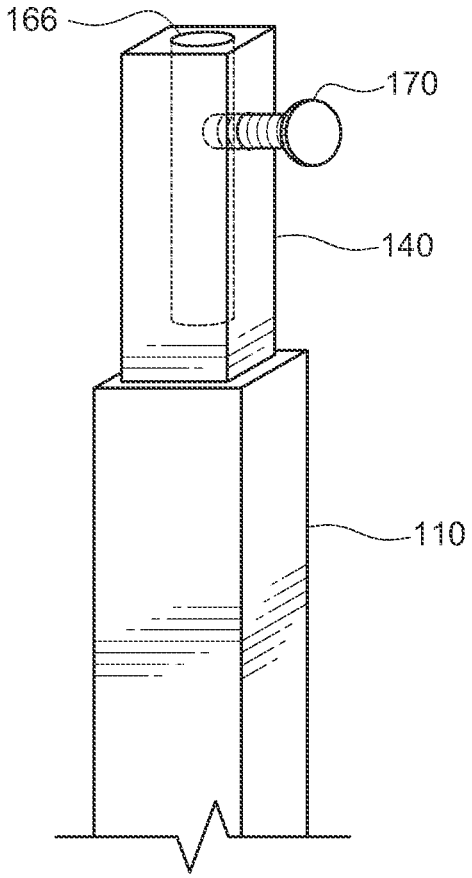
FIG. 10 shows a perspective view of a portion of an exemplary endpin stand apparatus of the present invention.

An internal-endpin set screw 170 may be used with aspects of the present invention having the internal-endpin shaft hole 166 to affix the endpin shaft 160 in the internal-endpin shaft hole 166, such as is illustrated in FIG. 10. The internal-endpin set screw 170 may not be needed in some aspects of the present invention, as the weight of the stringed instrument 200 may prevent the stringed instrument 200 and/or the endpin shaft 160 from moving relative to the rest of the endpin stand apparatus 100, though in some aspects of the present invention the internal-endpin set screw 170 may be desired to prevent the stringed instrument 200 and/or endpin shaft 160 from rotating or moving relative to the rest of the endpin stand apparatus 100. In some aspects of the present invention, the endpin shaft 160 may be made fixedly and immovably part of the internal tube 140. In other aspects of the present invention, the endpin shaft 160 may be removable from the internal tube 140, and it may be possible to replace an endpin shaft 160 of the endpin stand apparatus 100 with any of various different aspects of an endpin shaft 160. For instance, and without limiting the foregoing, the endpin shaft 160 that is used or placed with an aspect of the present invention may be a straight endpin shaft 161, an angled endpin shaft 162, or may be an endpin shaft 160 of a different length than is illustrated in the present disclosure.

With reference to FIG. 11, FIG. 12, FIG. 13, and FIG. 14, the endpin stand apparatus 100 may further comprise a platform 300. The platform 300 comprises a platform base 310 further comprising a platform hole 319; a platform cup 320, wherein the platform cup 320 is sized and shaped to accommodate an endpin plug or endpin block of a stringed instrument 200 and allow movement of an endpin plug or endpin block within the platform cup 320, and the platform cup 320 is disposed under the platform hole 319 such that an endpin plug can be passed through the platform hole 319 when the stringed instrument 200 is placed on the platform 300; a plurality of cup-platform-fasteners 322; a plurality of cup-bracket-fasteners 324; and a bracket 340 and the platform 300 may further comprise a bracket-tube fastener 350. The plurality of cup-platform-fasteners 322 reversibly affix the platform cup 320 to the platform base 310, and may comprise finger screws, latches, or any other fastener now known or later invented. The bracket 340 reversibly affixes the platform cup 320 to the internal tube 140, and may comprise a bracket in shape, or may comprise a plurality of components sized and shaped to fit concentrically outside of or inside of the internal tube 140, or the upright tube 110, or may comprise some other shape or form that allows the platform cup 320 to be reversibly affixed to the internal tube 140 or upright tube 110. The bracket 340 may be snugly fitted to the internal tube 140 or the upright tube 110, or may be reversibly affixed and removed with a bracket-tube fastener 350. The plurality of cup-bracket-fasteners 324 reversibly affix the platform cup 320 to the bracket 340, and may comprise bolts, finger screws, latches, or any other fastener now known or later invented. The bracket-tube fastener 350 may comprise a quick-release bolt with nut, or may comprise a screw or bolt with a wing nut or similar, or may comprise any type of fastener now known or later invented.

With reference to FIG. 11, FIG. 12, FIG. 13, and FIG. 14, the platform base 310 may, advantageously, be flat or approximately flat, or may in some aspects of the endpin stand apparatus 100 be curved. The platform 300 may, in some aspects of the present disclosure, be rotated side-to-side (which may be achieved with the cup-platform-fasteners 322 being loosened, the platform base 310 rotated relative to the platform cup 320 with the cup-platform-fasteners 322 in curved slots milled or formed in the platform cup 320, and the cup-platform-fasteners 322 being tightened) and/or front-to-back (which may be achieved by loosening the bracket-tube fastener 350, tilting the bracket 340 relative to the internal tube 140 or the upright tube 110, and tightening the bracket-tube fastener 350).

The platform base 310 may be covered in part or in whole with a platform padding 316. The platform padding 316 may comprise a foam material, including but not limited to a memory foam or other material now known or later invented, and may be uniform in thickness, advantageously from approximately ⅛" to approximately 4" thick, or may be approximately 2" thick, or may vary in thickness across the extent of the platform padding 316, or may be thicker in the approximate vicinity of the platform hole 319 and platform cup 320, such that the platform padding 316 is primarily contacting the stringed instrument 200 in the lower rib area of the stringed instrument 200. The platform padding 316 may be covered with a cover of cloth, velvet, a non-slip cloth or other non-slip material, or other material now known or later invented. The platform padding 316 may be reversibly attached to and removed from the platform base 310 with a plurality of padding fasteners 318, which plurality of padding fasteners 318 may comprise hook-and-loop fasteners, or may comprise zippers, snaps, buttons, and/or straps, or other types of fasteners, as will be apparent to one of skill in the art. The plurality of padding fasteners 318 may be placed on or used on more than just the platform base 310, as described below. Because the lower rib area of a stringed instrument 200 is curved, when the stringed instrument 200 is on the platform 300, the weight of the stringed instrument 200 is centered on the area around the stringed instrument 200 endpin plug or endpin block, and on the platform 300 in the vicinity of the platform hole 319. This is the strongest part of the stringed instrument 200 because of the internal block and the strength of the instrument ribs glued to the internal block. The platform padding 316 assists the musician 220 in playing the stringed instrument 200, by preventing the stringed instrument 200 from twisting axially relative to the platform 300, which would be destabilizing to the left hand of the musician 220 on the stringed instrument 200, which would be detrimental because the left hand does the fingering (playing) of notes. In aspects of the endpin stand apparatus 100 with a platform-front-support 314, the platform-front-support 314 also helps prevent axial twisting of the stringed instrument 200.

The platform 300 may further comprise a platform-rear-support 312, and may further comprise a platform-front-support 314. The platform-rear-support 312 may comprise, and be covered in part or in whole with a platform-rear-support-padding 315. The platform-front-support 314 may comprise, and be covered in part or in whole with a platform-front-support-padding 317. The platform-rear-support-padding 315 may comprise a padding material such as approximately ½" thick neoprene rubber, or other material now known or later invented. The platform-front-support-padding 317 may comprise a padding material such as approximately ½" thick neoprene rubber, or other material now known or later invented. The platform-rear-support-padding 315 may be reversibly attached to and removed from the platform-rear-support 312 with a plurality of padding fasteners 318, which plurality of padding fasteners 318 may comprise hook-and-loop fasteners, or may comprise zippers, snaps, buttons, and/or straps, or other types of fasteners, as will be apparent to one of skill in the art. The platform-front-support-padding 317 may be reversibly attached to and removed from the platform-front-support 314 with a plurality of padding fasteners 318, which plurality of padding fasteners 318 may comprise hook-and-loop fasteners, or may comprise zippers, snaps, buttons, and/or straps, or other types of fasteners, as will be apparent to one of skill in the art. The platform-rear-support 312 and/or the platform-front-support 314 support the back outer edge or front outer edge, respectively, of the stringed instrument 200 back or front, in the lower curvature of the stringed instrument 200 where the back or front structurally attaches to the ribs of the stringed instrument 200, close to the lower internal block where the stringed instrument 200 is structurally strongest. The platform-rear-support 312 keeps the stringed instrument 200 from sliding off the back of the platform 300.

Figure 14:
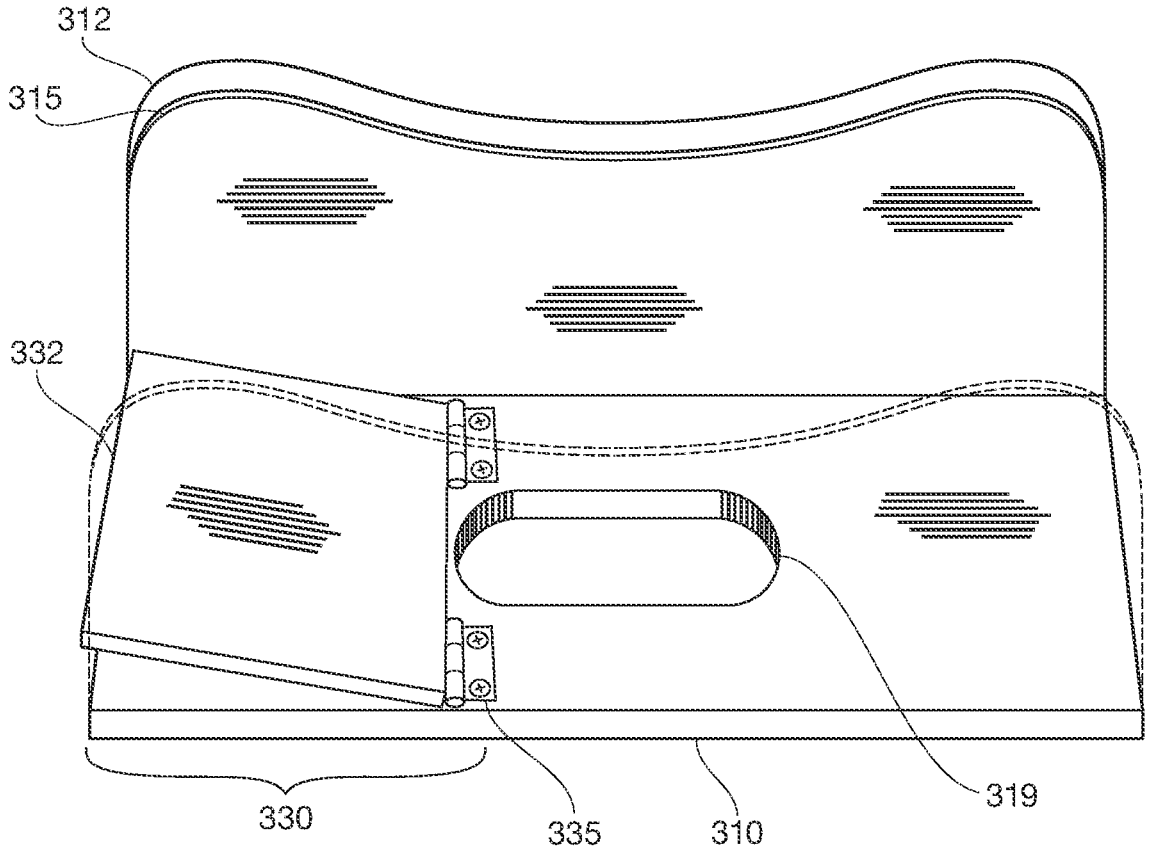
FIG. 14 shows a top perspective view of a portion of an exemplary endpin stand apparatus of the present invention.

With reference to FIG. 12 and FIG. 14, the platform 300 may further comprise a plurality of platform-tilt-mechanisms 330. The platform-tilt-mechanisms 330 may be used to tilt the stringed instrument 200 slightly, and adjustably, to the side, which is advantageous to any musician 220, because part of the mechanism of the stringed instrument 200 that attaches the neck to the body is known as a button, and protrudes backward from the stringed instrument 200 such that it would dig into the musician 220 if the stringed instrument 200 were not tilted to a side. The plurality of platform-tilt-mechanisms 330 may comprise a platform-tilt-panel 332; a plurality of platform-tilt-adjusters 334; and a plurality of platform-tilt-hinges 335. In other aspects of the endpin stand apparatus 100, the platform-tilt-mechanisms 330 may comprise a plurality of platform-tilt-panels 332, or may comprise a wedge of material, or the platform-tilt-mechanisms 330 may be integrated with the platform padding 316 such that the platform padding 316 tilts the stringed instrument 200 to a side. In aspects where the platform-tilt-mechanisms 330 comprise a plurality of platform-tilt-panels 332, the plurality of platform-tilt-adjusters 334 may be located above or below or to a side of the platform base 310, and may comprise a thumb screw or other mechanism now known or later invented that may be used to reversibly adjust the height and tilt angle of the platform-tilt-panel 332 relative to the platform base 310, with the platform-tilt-hinges 335 serving as the attachment and pivot point or pivot edge of the platform-tilt-panel 332; the platform-tilt-hinges 335 can be simple hinges, or a piano hinge, or other mechanism now known or later invented, not necessarily hinges.

Figure 15:
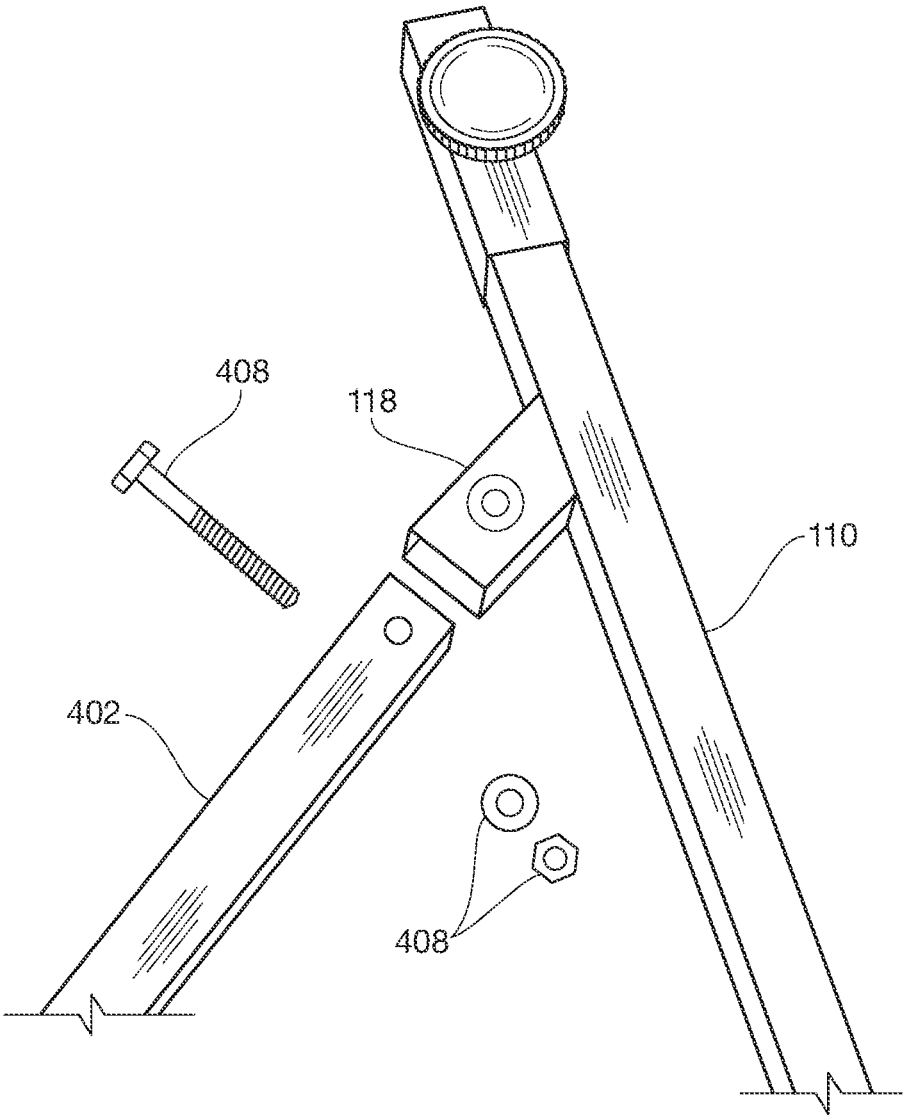
FIG. 15 shows a side perspective view of a portion of an exemplary endpin stand apparatus of the present invention.

With reference to FIG. 11, FIG. 12, and FIG. 15, the endpin stand apparatus 100 may, in some aspects, further comprise a kickstand 400, wherein the kickstand 400 comprises a kickstand-tube 402 and a kickstand-upright-fastener 408, which kickstand-upright-fastener 408 reversibly attaches the kickstand-tube 402 to the upright tube 110 at an upright-kickstand-tube joint 118, wherein the upright tube 110 comprises the upright-kickstand-tube joint 118, which is affixed to or made as part of the upright tube 110. The kickstand 400 provides support and stability to the endpin stand apparatus 100. The kickstand 400 may be removable; or may be made such that the kickstand 400 reversibly folds against the endpin stand apparatus 100, specifically against the upright tube 110, the ground tube 120, or both; or the kickstand 400 may be both removable and may reversibly fold. The kickstand-upright-fastener 408 may comprise a quick-release bolt with nut, or may comprise a screw or bolt with a wing nut or similar, or may comprise any type of fastener now known or later invented. The kickstand 400 may further comprise a kickstand-base 404, which kickstand-base 404 may be approximately perpendicular to the kickstand-tube 402, and disposed to sit on the ground, and wherein the kickstand-base 404 may be reversibly affixed to and removed from the kickstand-tube 402. The kickstand 400 may further comprise a plurality of kickstand-feet 406, wherein the plurality of kickstand-feet 406 may comprise part of, or may be reversibly affixed to, the kickstand-tube 402 and/or to the kickstand-base 404.

Certain aspects of the present invention were described above. From the foregoing it will be seen that this invention is one well adapted to attain all the ends and objects set forth above, together with other advantages, which are obvious and inherent to the system and method of the present invention. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

Accordingly, what is claimed is:

1. An endpin stand apparatus for support of a stringed instrument, comprising:
- a ground tube;
- an upright tube;
- an upright-ground connector;
- an internal tube;
- an upright-internal fastener; and
- a platform, wherein the platform further comprises:
- a platform base, the platform base further comprising: a platform hole and a platform cup, and wherein the platform cup is disposed under the platform hole;
- a plurality of cup-platform-fasteners, wherein the plurality of cup-platform-fasteners reversibly affix the platform cup to the platform base;
- a plurality of cup-bracket-fasteners; and
- a bracket, wherein the bracket reversibly affixes the platform cup to the internal tube, and wherein the plurality of cup-bracket-fasteners reversibly affix the platform cup to the bracket.

2. The endpin stand apparatus of claim 1, wherein the platform further comprises a bracket-tube fastener.

3. The endpin stand apparatus of claim 1, wherein the bracket is snugly fitted to the internal tube or the upright tube.

4. The endpin stand apparatus of claim 1, wherein the platform cup is sized and shaped such that an endpin plug or an endpin block of the stringed instrument can be passed through the platform hole when the stringed instrument is placed on the platform, to accommodate the endpin plug or the endpin block and allow movement of the endpin plug or the endpin block within the platform cup.

5. The endpin stand apparatus of claim 1, wherein the platform base is flat.

6. The endpin stand apparatus of claim 1, wherein the platform base is curved.

7. The endpin stand apparatus of claim 1, wherein the platform base can be rotated side-to-side and front-to-back.

8. The endpin stand apparatus of claim 1, wherein the platform base is covered in part or in whole with a platform padding.

9. The endpin stand apparatus of claim 8, wherein the platform padding is reversibly attached to and removed from the platform base with a plurality of padding fasteners.

10. The endpin stand apparatus of claim 1, wherein the platform further comprises a platform-rear-support.

11. The endpin stand apparatus of claim 10, wherein the platform further comprises a platform-rear-support-padding and a plurality of padding fasteners, and wherein the platform-rear-support is covered in part or in whole with the platform-rear-support-padding, and wherein the platform-rear-support-padding is reversibly attached to and removed from the platform-rear-support with the plurality of padding fasteners.

12. The endpin stand apparatus of claim 1, wherein the platform further comprises a platform-front-support, a platform-front-support-padding and a plurality of padding fasteners, and wherein the platform-front-support is covered in part or in whole with the platform-front-support-padding, and wherein the platform-front-support-padding is reversibly attached to and removed from the platform-front-support with the plurality of padding fasteners.

13. The endpin stand apparatus of claim 1, wherein the platform further comprises a plurality of platform-tilt-mechanisms.

14. The endpin stand apparatus of claim 13, wherein the plurality of platform-tilt-mechanisms comprise a plurality of platform-tilt-panels; a plurality of platform-tilt-adjusters; and a plurality of platform-tilt-hinges.

15. An endpin stand apparatus for support of a stringed instrument, comprising:
- a ground tube;
- an upright tube, the upright tube comprising an upright-kickstand-tube joint;
- an upright-ground connector;
- an internal tube;
- an upright-internal fastener; and
- a kickstand, wherein the kickstand comprises a kickstand-tube and a kickstand-upright-fastener, which kickstand-upright-fastener reversibly attaches the kickstand-tube to the upright tube at the upright-kickstand-tube joint.

16. The endpin stand apparatus of claim 15, wherein the kickstand reversibly folds against the endpin stand apparatus.

17. The endpin stand apparatus of claim 15, wherein the kickstand further comprises a kickstand-base, the kickstand-base being approximately perpendicular to the kickstand-tube, and wherein the kickstand-base is reversibly affixed to and removed from the kickstand-tube.

18. The endpin stand apparatus of claim 17, wherein the kickstand further comprises a plurality of kickstand-feet, wherein the plurality of kickstand-feet are reversibly affixed to the kickstand-base.

19. An endpin stand apparatus for support of a stringed instrument, comprising:
- an upright tube, the upright tube comprising an upright-kickstand-tube joint;
- an internal tube;
- an upright-internal fastener;
- a platform, wherein the platform further comprises a plurality of platform-tilt-mechanisms; and
- a kickstand, wherein the kickstand comprises a kickstand-tube and a kickstand-upright-fastener, which kickstand-upright-fastener reversibly attaches the kickstand-tube to the upright tube at the upright-kickstand-tube joint.

* * * * *